US005350086A

United States Patent [19]

Martin et al.

[11] Patent Number: 5,350,086

[45] Date of Patent: Sep. 27, 1994

[54] ICE CHEST BEVERAGE DISPENSER HAVING A PRE-CHILL COIL

[75] Inventors: Herman H. Martin, Schaumburg, Ill.; Michael S. Long, New Hartford, Conn.

[73] Assignee: Wilshire Partners, Cleveland, Ohio

[21] Appl. No.: 169,180

[22] Filed: Dec. 20, 1993

Related U.S. Application Data

[63] Continuation of Ser. No. 5,087, Jan. 15, 1993, abandoned.

[51] Int. Cl.[5] ..... B67D 5/62

[52] U.S. Cl. ..... 222/146.6; 62/398; 62/400; 222/129.1

[58] Field of Search ..... 222/129.1-129.4, 222/146.1, 146.6; 62/344, 390, 396, 398, 399, 400, 460, 461, 464, 339

[56] References Cited

U.S. PATENT DOCUMENTS

| | | | |
|---|---|---|---|
| 2,519,235 | 8/1950 | Dole | 62/398 |
| 2,607,519 | 8/1952 | Sanborn | 222/146.6 X |
| 2,612,357 | 9/1952 | Parks | 261/11 |
| 3,011,323 | 12/1961 | Jaeger | 222/146.6 X |
| 3,248,898 | 5/1966 | Stiller | 62/399 X |
| 3,331,536 | 7/1967 | De Lorenzo | 222/108 |
| 4,555,045 | 11/1985 | Rodth et al. | 222/146.6 X |
| 4,555,045 | 11/1985 | Rodth et al. | 222/146.6 X |
| 4,651,538 | 3/1987 | Bull et al. | 62/400 X |
| 4,678,104 | 7/1987 | Pritchett | 222/146.6 |
| 4,742,939 | 5/1988 | Galockin | 222/68 |
| 4,958,505 | 9/1990 | Swanson | 222/146.6 X |
| 4,969,576 | 11/1990 | Merrill et al. | 222/146.6 X |
| 5,033,645 | 7/1991 | Shannon | 222/61 |
| 5,080,261 | 1/1992 | Green | 222/146.6 X |
| 5,226,296 | 7/1993 | Kolvites et al. | 222/146.6 X |
| 5,249,710 | 10/1993 | Hassell et al. | 222/146.6 |

FOREIGN PATENT DOCUMENTS

| | | | |
|---|---|---|---|
| 643489 | 6/1962 | Canada | 222/146.6 |
| 2194508A | 3/1988 | United Kingdom . | |

*Primary Examiner*—Kevin P. Shaver

*Attorney, Agent, or Firm*—Vickers Daniels & Young

[57] ABSTRACT

An ice chest-type soft drink dispenser containing a body of ice in contact with a cold plate at the bottom thereof. The cold plate contains syrup and carbonated water tubes through which syrup and carbonated water passes, respectively. A pre-chill coil of a plurality of turns of tubing embedded in an aluminum body is provided, separate from the cold plate and the tubing is in fluid communication with the carbonated water tube and a source of carbonated water.

46 Claims, 5 Drawing Sheets

ICE CHEST BEVERAGE DISPENSER HAVING A PRE-CHILL COIL

This is a continuation of application Ser. No. 005,087, filed Jan. 15, 1993, now abandoned.

BACKGROUND OF DISCLOSURE

This invention pertains to dispensers for carbonated beverages and more particularly to dispensers using a cold plate containing ice chest to chill beverages prior to dispensing.

Soft drink dispensers are found in many restaurants, amusement parks, movie theaters, and elsewhere. Such dispensers are advantageous wherever the public wishes to obtain and consume chilled beverages. One type of beverage dispenser uses an ice chest including a cast aluminum cold plate to chill carbonated water and flavoring syrups before the mixing of these liquids and the dispensing of these liquids and a finished soft drink. Such dispensers consist of a source of carbonated water (soda), a source of flavoring syrup, a cold plate to cool the soda and syrup, and dispensing valves to mix the soda and syrup and dispense the mixed beverage into a cup. The chilling of the syrups and carbonated water to an appropriate uniform low temperature prior to mixing and dispensing is important to dispensing a quality drink. Proper uniform low temperature is necessary for precise proportioning of syrup to carbonated water and also prevents the mixed beverage from foaming and losing carbonation during the dispensing operation. The chilling of these fluids to a uniform low temperature in a beverage dispenser is difficult because of the wide variety of environments in which such dispensers must operate. Dispensers are mass produced and sold to organizations ranging form single location small restaurants to huge amusement parks. Beverage dispensers are used in controlled environments such as the interiors of restaurants and also exposed environments such as on the midway of an amusement park. The ambient temperatures in which these dispensers must operate vary from low spring temperatures of 40° F. (40° C.) at northern amusement parks in May to over 105° F. (40° C.) in exposed southern conditions. Moreover, the temperature of incoming syrup and carbonated water varies over a similar broad range.

Numerous attempts have been made in the past to address this problem. One approach has been to use very long tubes carrying carbonated water and syrup through the cold plate. This results in a very heavy and expensive cold plate. In one such approach, a five sided cold plate having a massive bottom portion and four upstanding side portions integrally formed with the massive body portion is constructed. A soda tube first winds completely around the periphery of the cold plate in the upstanding side portions and then winds in a serpentine path through the bottom portion of the cold plate before exiting the cold plate. Such an approach reduces the top surface area of the bottom section of the cold plate and also is expensive to manufacture. Additionally, if the upstanding side portions of the cold plate are warmed through lack of contact with ice or through a very warm input soda temperature, the bottom portion of the cold plate will be warmed by conduction. This may result in an inferior drink.

SUMMARY OF THE INVENTION

The present invention overcomes these and other problems in the prior art by use of a separate pre-chill structure for soda resulting in a superior beverage dispensed by the unit and low overall costs.

In accordance with the present invention, a beverage dispenser is provided having a source of carbonated water, a source of flavored syrup, an ice chest having a cold plate bottom with the cold plate containing tubes carrying soda and syrup through a serpentine path for cooling therein, beverage dispensing valves receiving soda and syrup from the cold plate and a separate pre-chill coil consisting of several turns of tubing embedded in a body of aluminum adapted to form a portion of the side walls of the ice chest.

Further in accordance with the invention, the pre-chill coil has a generally uniform cross-section including a thinner portion near it's bottom edge whereby the maximum surface area of the cold plate is exposed to ice within the ice chest.

Yet further in accordance with the invention, the pre-chill coil includes a downwardly inwardly sloping top portion whereby ice will slide by the pre-chill coil to replace melted ice below it rather then rest upon on the pre-chill coil.

Yet further in accordance with the invention, the pre-chill coil has a downwardly facing support surface resting upon the cold plate. The support surface is small in area whereby the pre-chill coil is thermally isolated from the cold plate.

Still further in accordance with the invention, a body of elastomeric sealant is position between the cold plate and the pre-chill coil further thermally isolating the pre-chill coil from the cold plate.

Yet further in accordance with the invention, the pre-chill coil is provided with a downwardly extending flange engaging the cold plate and locking the pre-chill coil in position with respect to the cold plate.

It is the principal object of the present invention to provide a beverage dispenser capable of delivering uniformly high quality mixed soft drinks.

It is another object of the present invention to provide a beverage dispenser delivering uniformly high quality soft drinks when the temperatures of input soda water and syrup varies over a wide range.

It is still another object of the present invention to provide a beverage dispenser which will deliver a high quality drink even should the level of ice in the ice chest fall to a low level.

It is yet another object of the present invention to provide a beverage dispenser which is inexpensive to manufacture and has a aluminum castings of simple, inexpensively cast shapes.

The invention may take physical form in certain parts and arrangements of parts, of preferred embodiment of which will be described in detail in this specification and illustrated in the accompanying drawings which form a part hereof and wherein:

DETAILED DESCRIPTION

Figure 1:
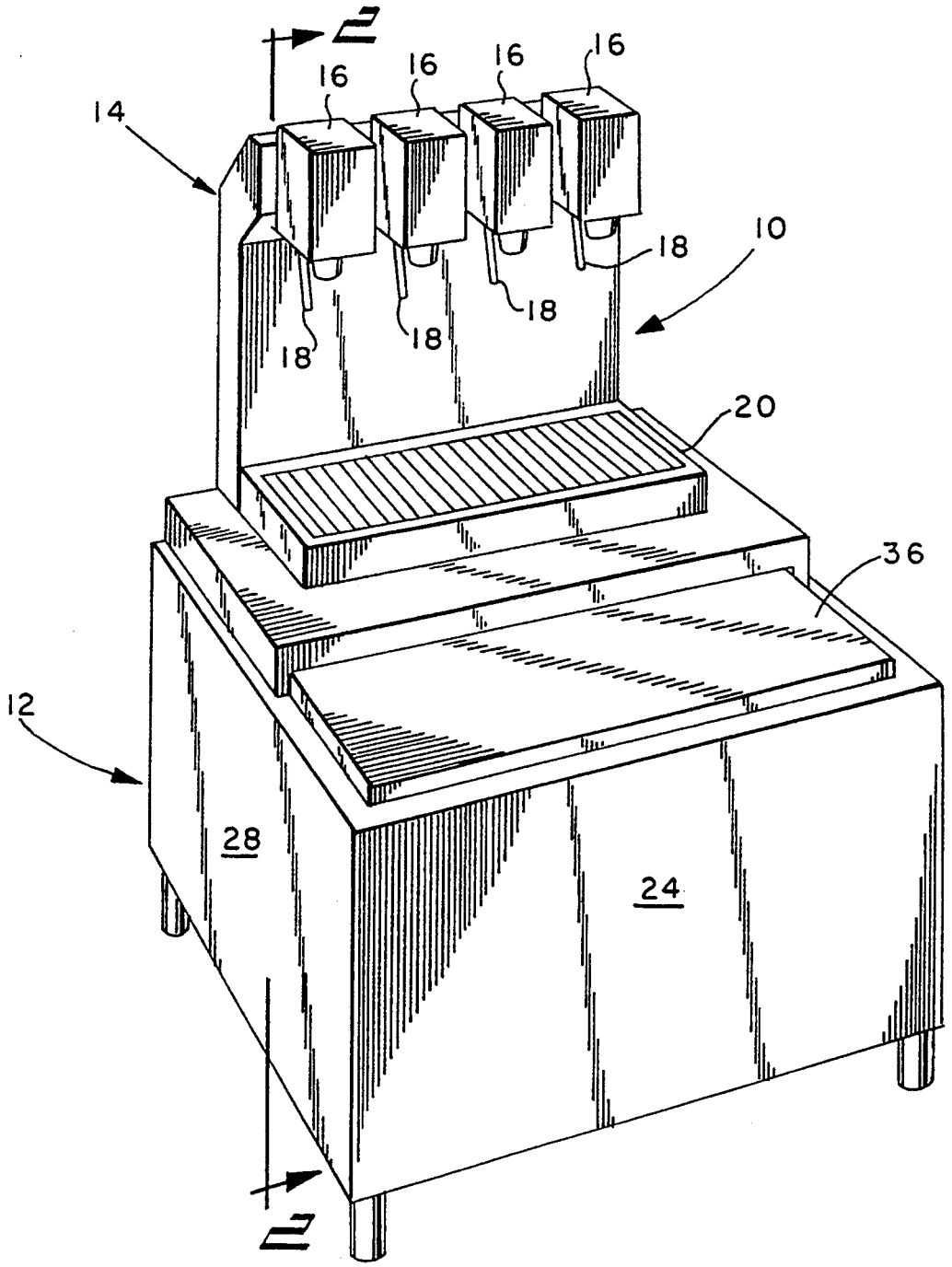
FIG. 1 is a perspective external view of a beverage dispenser.

Referring now to the drawings wherein the showings are made for the purpose of illustrating the preferred embodiment of the invention only and not for the purposes of limiting same, FIG. 1 shows a beverage dispenser 10 comprised of an ice chest 12 and a tower 14. A plurality of dispensing valves 16 are mounted on the top of the tower 14. Portions of beverage may be dispensed through the valves 16 when one of the actuating levers 18 is depressed. A drip pan 20 collects any spilled beverage.

Figure 2:
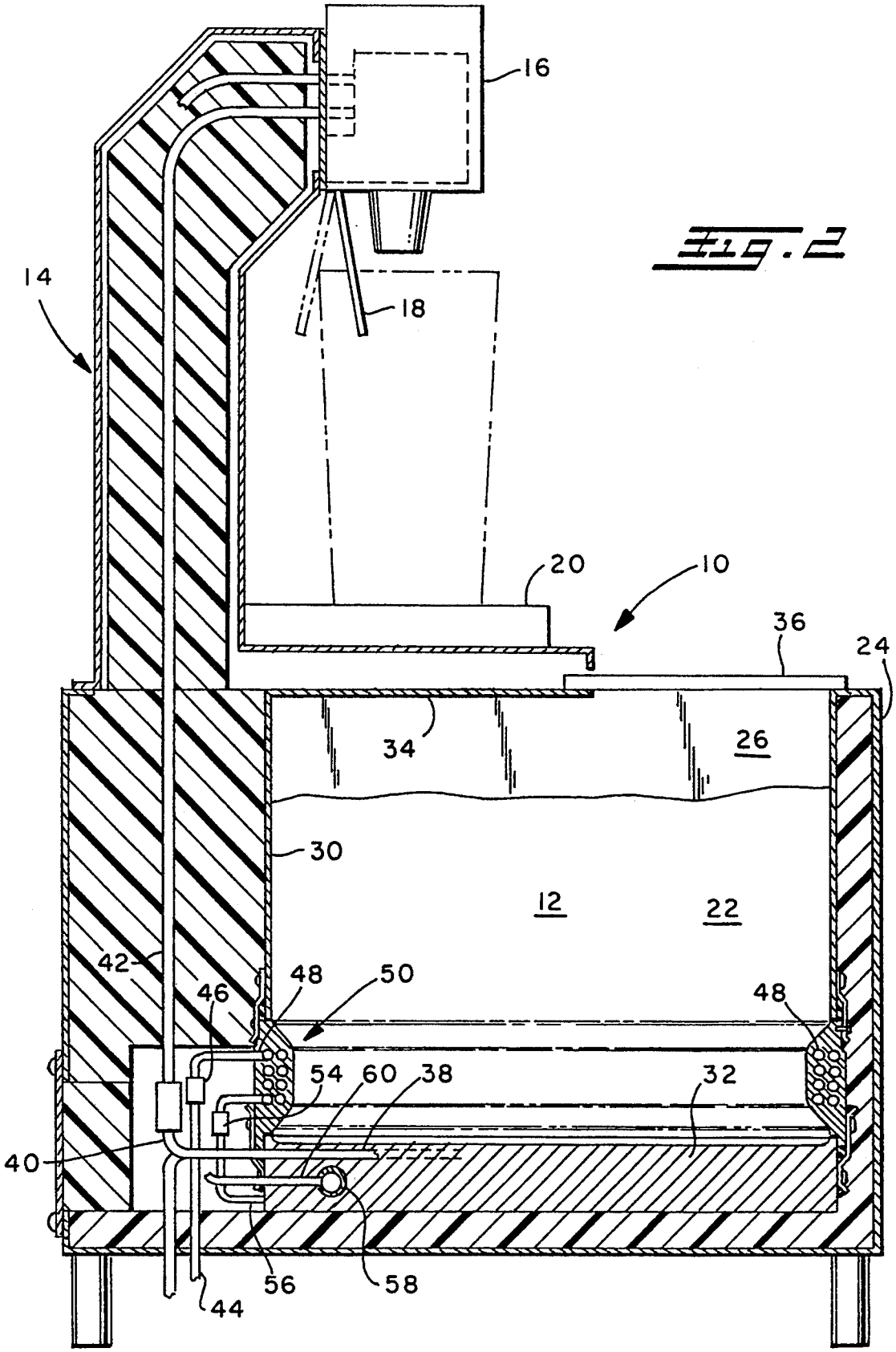
FIG. 2 is a cross section taken along line 2—2 of FIG. 1 of a beverage dispenser showing a separate pre-chill coil in accordance with the present invention.

The ice chest 12 has an ice containing chamber 22 surrounded by a front wall 24, a right hand side wall 26, a left hand side wall 28 and a rear wall 30. The bottom of the ice containing chamber 22 is defined by a cold plate 32. A drain (not shown) is provided near one corner of the cold plate 32 to remove water. The cold plate is slightly tilted to position the drain near the bottom most point of the ice containing chamber 22. The top of the ice containing chamber 22 is closed by a fixed top portion 34 and a top door 36 which may be opened to put ice into the ice containing chamber 22. As can be best seen in FIG. 2, the cold plate 32 is a block of aluminum with a multiplicity of stainless steel tubes embedded therein. Several syrup tubes 38 receive syrup from a source of syrup (not shown). The tubes 38 wind in a serpentine manner within the cold plate 32 so as to have a long length exposed to the low temperature of the cold plate. The downstream end 40 of the cold plate syrup tubes 38 are connected to syrup conduits 42 which convey the chilled syrup to the dispensing valves 16.

One or more soda tubes 44 convey carbonated water or soda from a source of soda (not shown) to a connecter 46 at one end of a stainless tube 48 embedded in the pre-chill coil assembly 50. The stainless steel tube 48 makes a number of complete circuits around the ice containing chamber 22 within an aluminum casting 52 that can be best seen in FIGS. 3 and 4. In one embodiment, the tube 48 makes eight complete circuits the individual circuits being arranged as four pairs vertically stacked. Alternatively, if two soda lines are used to provide carbonated water to the beverage dispenser (which is common) two separate stainless steel tubes 48 will be provided and arranged to each have multiple circuits around the inside periphery of the ice containing chamber 22 in the casting 52. In either design, a unitary casting 52 is provided for the pre-chill coil assembly 50.

After the soda water has been pre-chilled in the stainless steel tube 48, it proceeds through a connector 54 behind the cold plate, and into a stainless steel soda tube 56 within the cold plate 32. The stainless tube 56 winds through a long serpentine path within the cold plate 32 and finally feeds chilled soda into a manifold 58. Individual product soda tubes 60 convey the chilled soda from the manifold, out of the cold plate 32 and up through the tower 14 to the dispensing valves 16.

Figure 3:
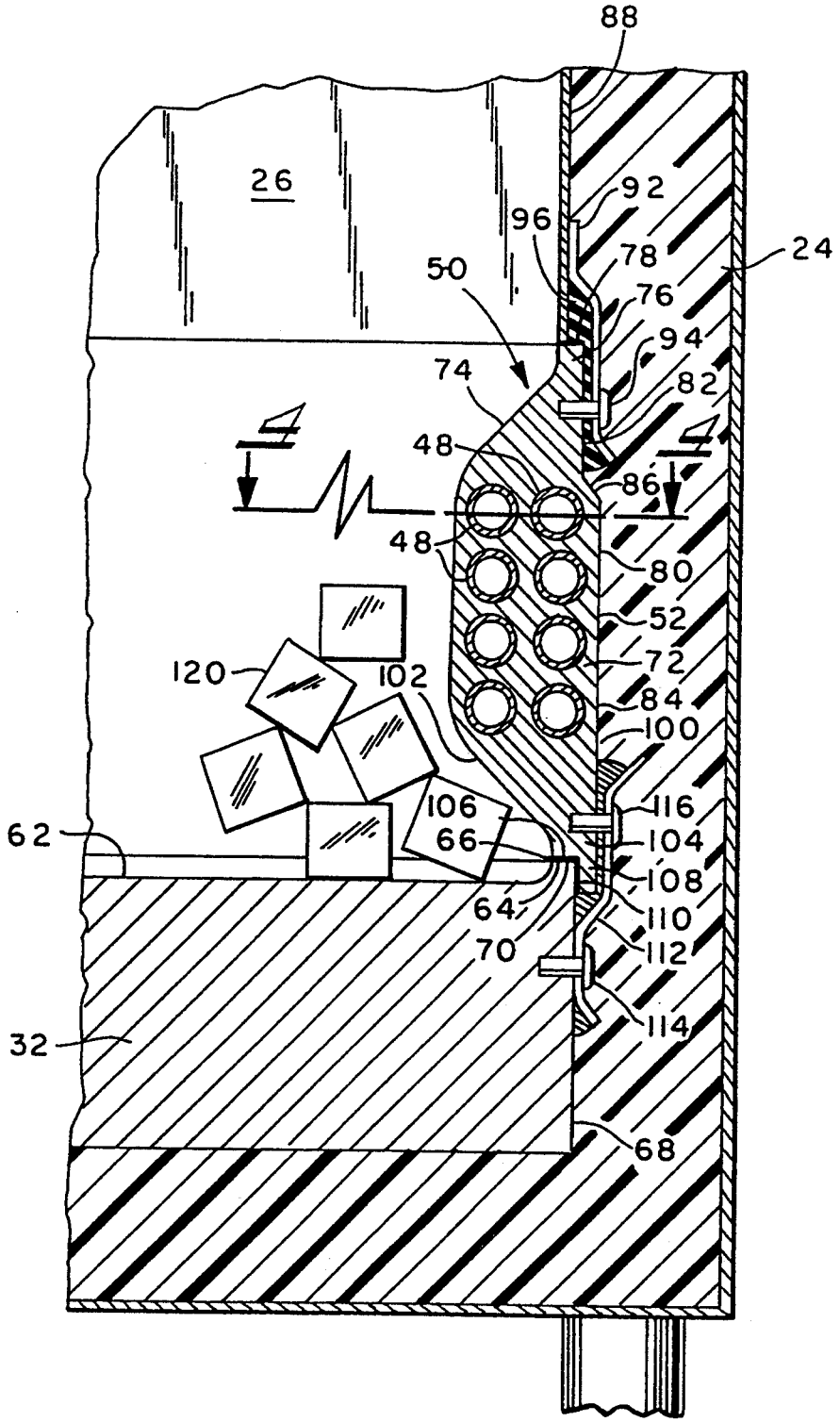
FIG. 3 is an enlargement of the pre-chill coil casting arrangement from FIG. 2.

As can be best seen FIG. 3, the pre-chill coil assemble 50 and the cold plate 32 are shaped to interact to provide optimum chilling of soda and syrup. The cold plate 32 is generally flat and has a generally flat ice bearing top surface 62. An upstanding lip 64 completely surrounds the ice bearing surface 62. The upstanding lip has a horizontal top surface 66. The top surface 66 completely surrounds the cold plate 32 but it small in area due it's narrow width.

Figure 4:
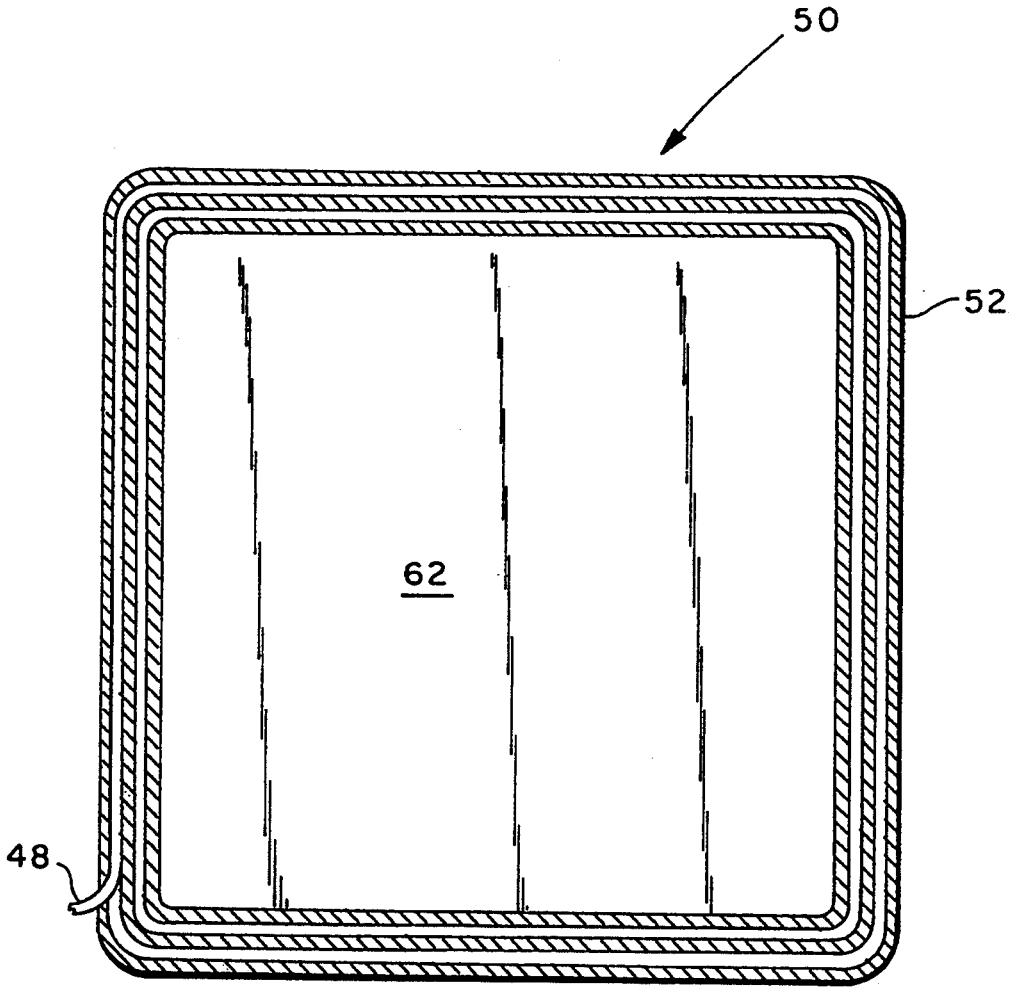
FIG. 4 is plan view of the pre-chill coil shown in FIGS. 1-3.

The cold plate 32 has four substantially vertical side walls 68. The pre-chill coil assembly 50, as can be best seen in FIG. 4, is generally rectangular in shape. The overall outer shape is identical to the outer shape of the cold plate 32. As can be best seen in FIG. 3, a small body of elastomeric sealant 70 sits on top of the lip 64. This body of elastomeric sealant 70 also fills the slight gap between the outside side walls 68 of the cold plate 32 and the pre-chill coil assembly 50.

The pre-chill coil assembly 50 has a generally uniform cross section on all four sides. The central portion 72 is thick and accommodates the multiple turns of the steel tube 48. As can be seen FIG. 3, the central portion 72 is thick enough to accommodate two side by side circuits of the tube 48 and still have sufficient room for an adequate body of aluminum surrounding the tubes. Above the central portion 72, the pre-chill coil assembly 50 has an upwardly and outwardly sloping surface 74 leading to a top lip 76. The top lip has a narrow horizontal upper surface 78. The outer side 80 of the coil assembly 52 is substantially flat. It comprises an upper outer side 82 and a lower outer side 84 the upper outer side 82 is separated from the lower outer side 84 by an outer shoulder 86. The outer shoulder 86 allows the upper outer side 82 to be displaced inwardly with respect to the lower outer side 84. The upper outer side 82 is displaced inwardly so that the outside dimensions of the upper outer side 82 of the coil assembly 50 are substantially identical to the outside dimensions of the side wall 68 of the cold plate 32. This allow the use of existing designs for ice chests with the current invention. Rather then redesigning cold plates or ice chest side walls, the ice chest side wall is simply shortened in height and mounted on top of the pre-chill coil assembly 50 which is in turn mounted on top of the cold plate 32.

The metal walls 88 of the ice containing chamber 22 rest conveniently on the horizontal upper surface 78 of the pre-chill coil assembly 50. The metal walls 88 are held in place by brackets 92 which are fixed to the metal walls by spot welding or the like and to the pre-chill coil assembly 50 by pop rivets 94 or the like. A body of sealant 96 seals the joint between the metal side walls 88 and the pre-chill coil assembly 50. The sealant used here and between the pre-chill coil 50 and the cold plate 32 is selected from the numerous commercially available sealants approved by the National Sanitation Foundation for use in food dispensing equipment. One such sealant is available from Dow Corning identified as "732 Silastic".

The lower portion 100 of the pre-chill coil assemble 50 has a downwardly narrowing cross-section. The lower inner surface 102 slopes downwardly and outwardly converging toward the lower outer side 84. The lower inner surface 102 terminates in a downwardly extending mounting portion 104. The mounting portion 104 includes an inner horizontal downwardly facing surface 106 and a downwardly extending flange 108. The flange 108 has an inwardly facing vertical surface 110. The inwardly facing vertical surface 110 extends around the entire periphery of the pre-chill coil assembly 50 and defines a rectangle having exterior dimensions slightly larger then the exterior dimensions of the four side walls 68 of the cold plate 32. As can be best seen FIG. 3, a body of elastomeric material 70 fills the space between the upstanding lip 64 of the cold plate 32 and the inner horizontal downwardly facing 106 on the pre-chill coil 50. The space between the cold plate side wall 68 and the inwardly facing vertical surface 110 is also filled by a sealant. This can be the Silastic sealant body 70 extruding into this space or an epoxy adhesive sealant for a more permanent joint. Brackets 112 are fixed to the cold plate 32 by pop rivets 114 or the like and also to the pre-chill assembly 50 by pop rivets 116 or the like Conveniently, pop rivet holes are cast or drilled into the pre-chill assembly 50 to be aligned with pre-existing pop rivet holes in the cold plate 32. The brackets 112 can be additionally fixed to the pre-chill coil 50 and/or the cold plate 32 by use of an appropriate epoxy selected to bond to aluminum.

As can be best seen in FIG. 3, the interior profile the pre-chill coil provides several advantages. First, the downwardly inwardly (or upwardly outwardly) sloping upper surface 74 allows ice cubes 120 to slide past the pre-chill coil 50 rather then being retained on a horizontal upper surface. Fresh cubes are allowed to reach the cold plate 32. Additionally, the lower inner surface which slopes outwardly and downwardly allows the maximum ice baring top surface 62 to be exposed to ice cubes 120. Also, the small area of contact between the pre-chill coil 50 and the cold plate 32 at the upstanding lip 64 prevents the pre-chill coil from introducing heat into the cold plate 32. The small contact area minimizes heat flow. The body of elastomeric material 70 further isolates these two components one from the other and further minimizes the flow of heat from the pre-chill coil 50 to the cold plate 32. Thus, the pre-chill coil has virtually no negative impact upon the efficiency of the cold plate 32. This is especially important should the level of ice in the ice containing chamber 22 fall to a very low level. With little ice in contact with the pre-chill coil assembly 50 the pre-chill coil assembly would rise in temperature as warm carbonated water circulated through the tube 48. If not isolated from the cold plate 32, this heat could be transferred to the cold plate interfering with it's ability to chill soda and syrup in this unfavorable circumstance. With the present invention, heat transfer is minimized and, while the cold plate is covered with ice, it can continue to function at high efficiency.

With the ice chest adequately filled, it has been found that the addition of the pre-chill coil assemble 50 improves the operation of the dispenser both with respect to providing uniform temperature soda and with respect to providing uniform temperature syrup. It is believed that pre-chilling the soda in the pre-chill coil assembly 50 results in a better temperature profile throughout the cold plate 32 thereby improving syrup temperature and consistency as well as soda temperature. A uniform syrup temperature is important in providing a quality drink as it effects the viscosity of the syrup and therefore the final proportions of syrup and soda.

Figure 5:
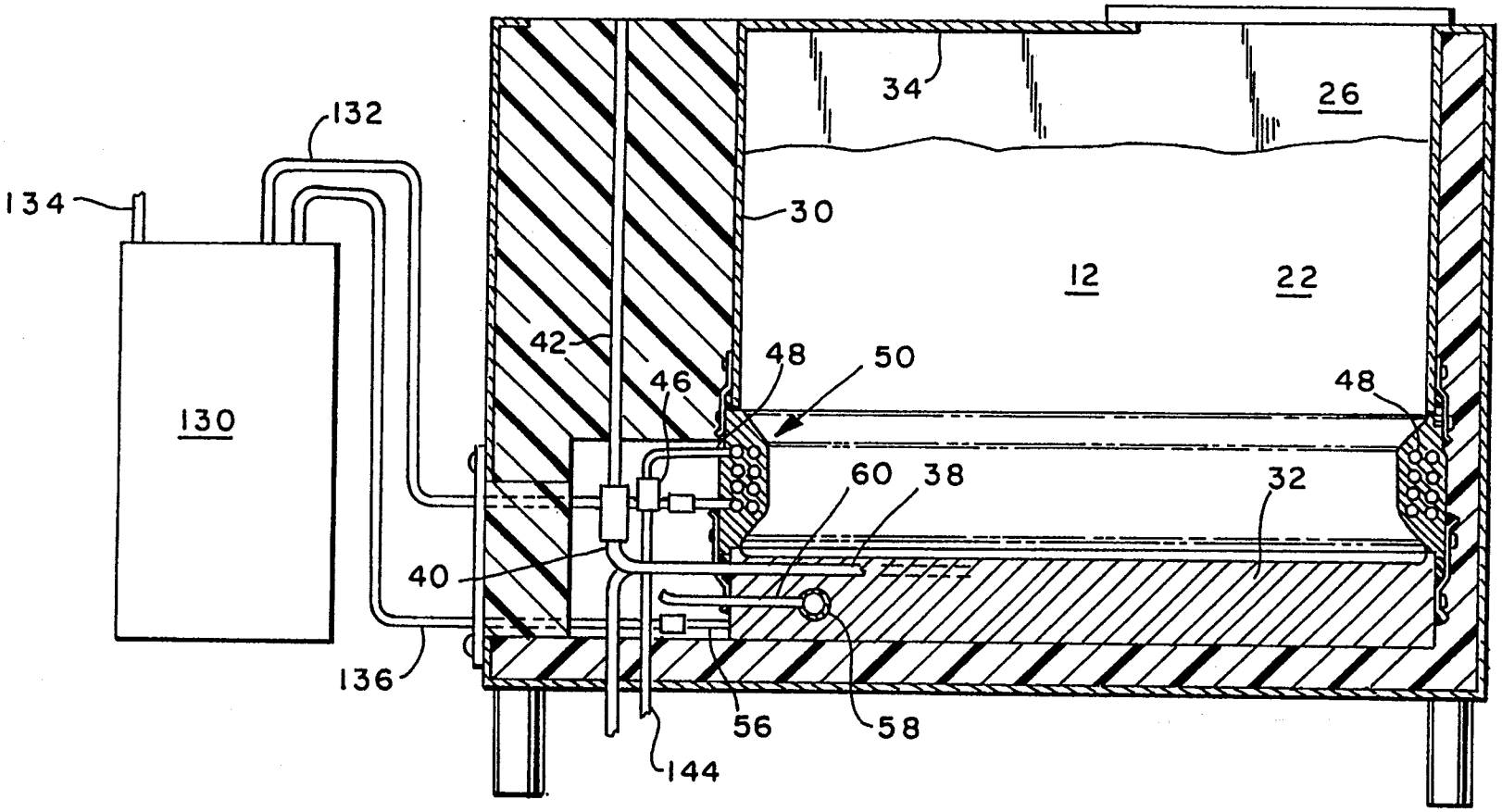
FIG. 5, shows the ice chest portion and carbonator of an alternate embodiment of the invention in which the pre-chill coil is used to chill water before it is carbonated.

FIG. 5 shows an alternate use of the pre-chill coil assembly 50. The figure shows only the ice chest 12 portion and, schematically, a conventional carbonator 130 as the tower 14 is identical to that seen in FIGS. 1 and 2. The pre-chill coil assembly 50 shown in FIG. 5 is identical to that seen in FIGS. 1–4, however, it is connected differently. The pre-chill coil assembly 50 receives water from a water inlet tube 144. The water is chilled in the coil assembly 50. The downstream end of the tube 48 is connected to a carbonator inlet tube 132 which conveys the chilled water to the carbonator 130. As is conventional, the carbonator 130 includes a pump which forces the water into a tank. Pressurized carbon dioxide is also introduced into the tank through a carbon dioxide line 134 and the water carbonated to form soda. The soda is carried through a carbonator outlet tube 136 and fed to the input of the cold plate stainless steel soda tube 56. The carbonator inlet tube 132, the carbonator outlet tube 136 and the carbonator are all insulated to preserve the chill imparted by the pre-chill coil assembly 50.

Chilled water is easier to carbonate than warm water. Use of chilled water in the carbonator 130 allows use of lower pressure. Use of the pre-chill coil assembly in the configuration also provides a more uniform level of carbonation because the input water temperature is regulated. A higher quality drink is provided without compromising the operation of the cold plate 32.

The invention has been described with reference to a preferred embodiment. Obviously, modifications and alternation will occur to others upon the reading and understanding of this specification and it is intended to include such modifications and alternations in so far as they come within the scope of the appended claims.

Having thus described the invention it is claimed:

1. An improvement in a beverage dispensing comprising a source of carbonated water; at least one source of flavored syrup; an ice chest adapted to contain a body of ice having a bottom, four side walls and a top, said bottom comprising a cold plate; said cold plate containing syrup tubes through which syrup passes; and at least one carbonated water tube through which said carbonated water passes; at least one beverage dispensing valve adapted to receive carbonated water and syrup from said cold plate and dispense a mixture of said carbonated water and syrup; the improvement comprising: a pre-chill coil comprised of a plurality of turns of tubing embedded within an aluminum body, separate from said cold plate, said pre-chill coil comprising four interconnected generally linear segments, said four segments general adjacent said ice chest side walls, said pre-chill coil in fluid communication with said source of carbonated water and said cold plate carbonated water tube.

2. The improvement of claim 1 wherein said aluminum body has a generally uniform cross-section comprising a generally vertical outer surface, a generally vertical inner surface, a bottom surface comprising a segment sloping upwardly over a portion of the distance from said outer surface to said inner surface and a top surface.

3. The improvement of claim 2 wherein said aluminum body top surface comprises a segment sloping downwardly over a portion of the distance from said outer surface to said inner surface.

4. The improvement of claim 3 wherein said bottom surface additional comprises a horizontal surface adapted to rest upon a horizontal surface of said cold plate.

5. The improvement of claim 4 wherein said cold plate comprises a raised lip around it's entire periphery, said raised lip having a horizontal upper surface, said lip upper surface supporting said aluminum body.

6. The improvement of claim 4 wherein said bottom surface additionally comprises a downwardly extending vertical flange adapted to closely surround said cold plate whereby said pre-chill coil is locked in place.

7. The improvement of claim 1 wherein said cold plate has an ice receiving surface and a peripheral lip surrounding said surface; and, the pre-chill coil does not obstruct said ice receiving surface whereby said ice receiving surface is adapted to be in contact with ice over it entire surface.

8. The improvement of claim 1 wherein said pre-chill coil has a downwardly inwardly sloping top surface whereby ice in said ice chest will slide past said pre-chill coil.

9. The improvement of claim 1 wherein said pre-chill coil is thermally isolated from said cold plate.

10. The improvement of claim 9 wherein said cold plate is provided with a raised peripheral lip having a horizontal top surface of relatively small area and said pre-chill coil is provided with a lower horizontal surface of relatively small area resting on said cold plate lip, whereby a small area of contact between said cold plate and said pre-chill coil is provided and provides said thermal isolation.

11. The improvement of claim 10 whereby a body of elastomeric sealant is positioned between said lip top surface and said pre-chill coil lower surface, adding to said thermal isolation.

12. A beverage dispenser comprising a source of carbonated water; at least one source of flavored syrup; an ice chest adapted to contain a body of ice within an ice chamber having a bottom, four side walls and a top; a cold plate forming said ice chest bottom, said cold plate comprising a first distinct body of aluminum having a plurality of tubes adapted to convey liquid embedded therein and a generally flat upper ice bearing surface, a plurality of said tubes adapted to receive flavored syrup from said source of flavored syrup; at least one beverage dispensing valve adapted to receive carbonated water and syrup from said cold plate and dispense a mixture of said carbonated water and syrup; a pre-chill coil comprised of a plurality of turns of tubing embedded in a second distinct body of aluminum, said pre-chill coil comprising four interconnected generally linear segments generally adjacent said ice chest side walls, said pre-chill coil adapted to receive carbonated water from said source of carbonated water and deliver carbonated water to said cold plate, said pre-chill coil being thermally isolated from said cold plate.

13. The beverage dispenser of claim 12 wherein said pre-chill coil has a lower bearing surface adapted to rest upon said cold plate and said lower bearing surface has a relatively small total area whereby said pre-chill coil is thermally isolated from said cold plate.

14. The dispenser of claim 13 including a body of elastomeric sealant between said cold plate and said pre-chill coil.

15. The dispenser of claim 12 wherein said pre-chill coil includes a locking means to fix the position of said pre-chill coil with respect to said cold plate.

16. The dispenser of claim 15 wherein said locking means comprises a downwardly extending flange engaging said cold plate.

17. The dispenser of claim 12 wherein said ice chamber has a generally uniform horizontal cross-section, said cross-section being reduced by a portion of said pre-chill coil and said cross section being larger than said reduced portion below said reduced portion.

18. The dispenser of claim 17 wherein said pre-chill coil has a generally uniform vertical cross-section including a relatively thick central portion and a relatively thin lower portion.

19. The dispenser of claim 18 wherein said pre-chill coil has a generally flat vertical outer wall and an inner wall comprising a generally downwardly inwardly sloping upper segment, a generally flat vertical central segment and a generally downwardly outwardly sloping lower segment.

20. The dispenser of claim 19 wherein said pre-chill coil has a lower bearing surface adapted to rest upon said cold plate and lower bearing surface has a relatively small total area, said lower bearing surface being disposed below said downwardly outwardly sloping segment.

21. The dispenser of claim 20 wherein said pre-chill coil additionally comprises a downwardly extending flange adapted to engage said cold plate, said flange being disposed below said lower bearing surface.

22. An improvement in a beverage dispensing comprising a source of diluent; at least one source of flavored syrup; an ice chest adapted to contain a body of ice having a bottom, four side walls and a top, said bottom comprising a cold plate; said cold plate containing syrup tubes through which syrup passes; and at least one diluent tube through which said diluent passes; at least one beverage dispensing valve adapted to receive diluent and syrup from said cold plate and dispense a mixture of said diluent and syrup; the improvement comprising: a pre-chill coil comprised of a plurality of turns of tubing embedded within an aluminum body, separate from said cold plate, said pre-chill coil comprising four interconnected generally linear segments, said four segments general adjacent said ice chest side walls, said pre-chill coil in fluid communication with said source of diluent and said cold plate diluent tube.

23. The improvement of claim 22 wherein said aluminum body has a generally uniform cross-section comprising a generally vertical outer surface, a generally vertical inner surface, a bottom surface comprising a segment sloping upwardly over a portion of the distance from said outer surface to said inner surface and a top surface.

24. The improvement of claim 23 where in said aluminum body top surface comprises a segment sloping downwardly over a portion of the distance from said outer surface to said inner surface.

25. The improvement of claim 24 wherein said bottom surface additional comprises a horizontal surface adapted to rest upon a horizontal surface of said cold plate.

26. The improvement of claim 25 wherein said cold plate comprises a raised lip around it's entire periphery, said raised lip having a horizontal upper surface, said lip upper surface supporting said aluminum body.

27. The improvement of claim 25 wherein said bottom surface additionally comprises a downwardly extending vertical flange adapted to a closely surround said cold plate whereby said pre-chill coil is locked in place.

28. The improvement of claim 22 wherein said cold plate has an ice receiving surface and a peripheral lip surrounding said surface; and, the pre-chill coil does not obstruct said ice receiving surface whereby said ice receiving surface is adapted to be in contact with ice over it entire surface.

29. The improvement of claim 22 wherein said pre-chill coil has a downwardly inwardly sloping top surface whereby ice in said ice chest will slide past said pre-chill coil.

30. The improvement of claim 22 wherein said pre-chill coil is thermally isolated from said cold plate.

31. The improvement of claim 30 wherein said cold plate is provided with a raised peripheral lip having a horizontal top surface of relatively small area and said pre-chill coil is provided with a lower horizontal surface of relatively small area resting on said cold plate lip, whereby a small area of contact between said cold plate and said pre-chill coil is provided and provides said thermal isolation.

32. The improvement of claim 31 whereby a body of elastomeric sealant is positioned between said lip top surface and said pre-chill coil lower surface, adding to said thermal isolation.

33. The improvement of claim 22 wherein said pre-chill coil is in fluid communication with a carbonator which is, in turn, in fluid communication with said cold plate diluent tube.

34. An improvement in a beverage dispensing comprising a source of diluent; at least one source of flavored syrup; an ice chest adapted to contain a body of ice having a bottom, four side walls and a top, said bottom comprising a cold plate; said cold plate containing syrup tubes through which syrup passes; and at least one diluent tube through which said diluent passes; at least one beverage dispensing valve adapted to receive diluent and syrup from said cold plate and dispense a mixture of said diluent and syrup; the improvement comprising: a pre-chill coil comprised of a plurality of turns of tubing embedded within an aluminum body, separate from said cold plate, said pre-chill coil comprising four interconnected generally linear segments, said four segments general adjacent said ice chest side walls, said pre-chill coil in fluid communication with said source of diluent and a carbonator, said carbonator in fluid communication with said cold plate diluent tube.

35. An improvement in a beverage dispenser comprising a source of diluent; at least one source of flavored syrup; an ice chest adapted to contain a body of ice having a bottom, at least three side walls and a top, said bottom comprising a cold plate; said cold plate containing syrup tubes through which syrup passes; and at least one diluent tube through which said diluent passes; at least one beverage dispensing valve adapted to receive diluent and syrup from said cold plate and dispense a mixture of said diluent and syrup; the improvement comprising: pre-chill means for pre-chilling said diluent, said pre-chill means being thermally isolated from said cold plate.

36. The improvement of claim 35, wherein said pre-chill means is cooled by contact with said body of ice.

37. The improvement of claim 36, wherein said pre-chill means is adapted to pre-chill said syrup.

38. The improvement of claim 35, wherein said pre-chill means is disposed within at least one of the walls of said ice chest.

39. The improvement of claim 37, wherein said pre-chill means comprises at least one segment of tubing disposed within at least one of said ice chest side walls and in fluid connection with said source of syrup and said cold plate and at least one segment of tubing disposed within at least one of said ice chest side walls and in fluid connection with said source of diluent and said cold plate.

40. The improvement of claim 39, wherein said segment of tubing is embedded within a body of aluminum.

41. The improvement of claim 35, wherein said pre-chill means comprises a pre-chill coil comprised of a plurality of turns of tubing embedded within an aluminum body, separate from said cold plate, said tubing generally adjacent at least one of said ice chest side walls.

42. The improvement of claim 41, wherein said pre-chill coil is in fluid communication with said source of diluent and a carbonator, said carbonator in fluid communication with said cold plate diluent tube.

43. A beverage dispenser comprising an ice chest adapted to contain a body of ice having a bottom, at least three side walls and a top; a source of diluent; at least one source of flavored syrup; at least one beverage dispensing valve adapted to received said diluent and said syrup and dispense a mixture of said diluent and syrup; a chilling means for chilling said diluent, said chilling means fluidly connected between said diluent source and said at least one dispensing valve; and a pre-chill means thermally isolated from said chilling means for pre-chilling said diluent, said pre-chilling means fluidly connected between said chilling means and said diluent source.

44. A beverage dispenser according to claim 43, wherein said cold plate and said pre-chill means are in thermal contact with said body of ice.

45. A beverage dispenser according to claim 43, in which said pre-chill means and said chilling means are disposed within said ice chest.

46. A beverage dispenser according to claim 43, wherein said chilling means is adapted to chill said diluent and said syrup.

* * * * *